US006884765B2

(12) United States Patent
Bargaje

(10) Patent No.: US 6,884,765 B2
(45) Date of Patent: Apr. 26, 2005

(54) PROCESS FOR CLEANING FABRICS USING PETROLEUM ETHER AND WATER OR CYCLOHEROME AND WATER

(75) Inventor: Vijaya Milind Bargaje, Bangalore (IN)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/861,388

(22) Filed: May 18, 2001

(65) Prior Publication Data

US 2002/0019323 A1 Feb. 14, 2002

(30) Foreign Application Priority Data

May 23, 2000 (IN) ..... 469/MUM/00
Jul. 25, 2000 (GB) ..... 0018286

(51) Int. Cl.[7] ..... C11D 3/43; C11D 3/44

(52) U.S. Cl. ..... 510/285; 510/276; 510/281; 510/282; 510/304; 510/342; 510/407; 510/412; 510/417; 510/432

(58) Field of Search ..... 510/276, 281, 510/282, 285, 304, 342, 407, 412, 417, 432

(56) References Cited

U.S. PATENT DOCUMENTS

| | | | | | |
|---|---|---|---|---|---|
| 3,859,223 | A | * | 1/1975 | Castrantas et al. | 252/104 |
| 4,013,575 | A | * | 3/1977 | Castrantas et al. | 252/104 |
| 4,045,174 | A | | 8/1977 | Fuhring et al. | 8/142 |
| 4,108,599 | A | * | 8/1978 | Coll-Palagos et al. | 8/137 |
| 4,115,061 | A | | 9/1978 | Grunewalder | 8/137 |
| 4,176,080 | A | | 11/1979 | Wise et al. | 252/162 |
| 4,199,482 | A | * | 4/1980 | Renaud et al. | 252/559 |
| 4,378,968 | A | | 4/1983 | Peignier et al. | 8/142 |
| 4,530,781 | A | * | 7/1985 | Gipp | 252/546 |
| 4,650,493 | A | * | 3/1987 | Pahlsson et al. | 8/142 |
| 4,659,332 | A | * | 4/1987 | Hellsten | 8/142 |
| 5,035,826 | A | * | 7/1991 | Durbut et al. | 134/36 |
| 5,093,031 | A | * | 3/1992 | Login et al. | 516/68 |
| 5,112,358 | A | | 5/1992 | Deal, III | 8/137 |
| 5,238,587 | A | | 8/1993 | Smith et al. | 252/8.6 |
| 5,466,802 | A | * | 11/1995 | Panandiker et al. | 510/320 |
| 5,523,013 | A | * | 6/1996 | Durbut et al. | 510/235 |
| 5,634,947 | A | | 6/1997 | Kazama | 81/137 |
| 5,811,383 | A | * | 9/1998 | Klier et al. | 510/417 |
| 6,020,300 | A | * | 2/2000 | Tcheou et al. | 510/417 |

FOREIGN PATENT DOCUMENTS

| | | |
|---|---|---|
| EP | 0 075 546 | 3/1986 |
| EP | 842 606 | 3/2000 |
| GB | 922 270 | 3/1963 |
| GB | 1 312 284 | 4/1973 |
| GB | 1 470 332 | 4/1977 |
| GB | 1 493 619 | 11/1977 |
| GB | 1 545 188 | 5/1979 |
| GB | 2 144 763 | 3/1985 |
| WO | 82/02218 | 7/1982 |
| WO | 97/19164 | 5/1997 |
| WO | 97/35061 | 9/1997 |

OTHER PUBLICATIONS

GB Search Report in a GB application GB 0018286.5.
PCT International Search Report in a PCT/EP application PCT/EP 01/05310.

* cited by examiner

*Primary Examiner*—Charles Boyer
(74) *Attorney, Agent, or Firm*—Rimma Mitelman

(57) ABSTRACT

A process for cleaning textile fabric without the need for conventional detergent systems comprising agitating the fabric in a composition comprising at least two immiscible liquids, for example, perchloroethylene or petroleum ether and water, having at least one liquid-liquid interface with an interfacial tension of at least 5 mN/m, preferably at least 10 mN/m, and where the concentration of the most polar liquid in the composition is from 10 to 90% by volume.

18 Claims, No Drawings

PROCESS FOR CLEANING FABRICS USING PETROLEUM ETHER AND WATER OR CYCLOHEROME AND WATER

TECHNICAL FIELD

The invention relates to a method or a process of cleaning textile fabric without using, or using very much reduced levels of, conventional detergent surfactants.

BACKGROUND AND PRIOR ART

Conventionally fabric is cleaned using water and a detergent composition, which is known as wet cleaning. Surfactants in the detergent adsorb on both fabric and soil and thereby reduce the respective interfacial energies and this facilitates removal of soil from the fabric.

Alternatively it is done by a process called dry cleaning where organic non-polar solvents are used, generally aided by a surfactant. During dry cleaning, when a surfactant is used, a maximum of about 10% of water is also used along with the solvent system in order to facilitate the removal of water soluble stains. In dry cleaning, soil removal can be achieved by a small reduction in interfacial tension. The organic solvent helps in removal of oily soil in the presence of detergents and the particulate soil is largely removed by providing agitation.

Regardless of the type of solvent used, which may be water or an organic solvent, agitation of garments in the cleaning medium is essential to accelerate the removal of soluble soil or insoluble, particulate soil.

U.S. Pat. No. 4,115,061 (Henkel) discloses a method of cleaning using a combination of an organic solvent and a concentrated aqueous detergent solution for cleaning soiled textiles.

U.S. Pat. No. 4,378,968 (Chloe Chimie) discloses a process for reducing soil redeposition onto textiles in order to limit the phenomenon of 'greying' of the textiles by incorporating at least one primary or secondary alcohol as an anti redeposition adjuvant into the percholoroethylene solvent during dry cleaning.

GB 1493619, GB 1470332 and GB 1312284 (PPG Industries) disclose a method of treating fabrics in a two-phase liquid comprising a conventional drycleaning liquid as a major portion and a hydrogen peroxide bleaching solution as a minor portion. Typically the peroxide solution is present at less than 10 wt % of the drycleaning liquid (approximately 9 wt % of the two-phase liquid) and preferably less than 5 wt % of the drycleaning fluid (approximately 4.75 wt % of the two-phase liquid).

EP0075546A (Berol Kemi) discloses a water-in-perchloroethylene microemulsion containing 2–6 wt % emulsifier (surfactant) and 0.2–4 wt % solubilising agent included in order to reduce interfacial tensions to stabilise the emulsion thus formed.

WO97/19164A (Colgate-Palmolive) discloses a liquid fabric washing composition in three phases which comprises, among other ingredients, 1 to 15 wt % of non-polar liquid, 55 to 95wt % of a polar solvent, preferably water, and 1 to 23 wt % of a low molecular weight amphiphilic compound. The amphiphilic compound reduces the interfacial tensions to less than $10^{-3}$ mN/m to enable a single continuous phase to be formed with minimal mechanical agitation.

SUMMARY OF THE INVENTION

The present applicants have now found that cleaning fabric in a composition comprising at least two immiscible liquids, while providing agitation, results in superior cleaning as compared to conventional laundering methods.

DEFINITION OF THE INVENTION

Thus according to the present invention there is provided a process of cleaning fabric comprising agitating the fabric in a composition comprising at least two liquids, having at least one liquid-liquid interface with an interfacial tension of at least 5 mN/m, wherein the concentration of the most polar liquid in the composition is from 10 to 90% by volume.

DETAILED DESCRIPTION OF THE INVENTION

The process of the invention utilises a composition for cleaning fabric, comprising at least two immiscible liquids with a high interfacial tension.

Preferably the interfacial tension (IFT) of at least one liquid-liquid interface in the composition is at least 5 mN/m, preferably at least 8 mN/m, and more preferably at least 10 mN/m. Suitably the interfacial tension is at least 15 mN/m, advantageously at least 20 mN/m and desirably at least 35 mN/m. Interfacial tension may be measured using various techniques, such as sessile drop, pendant drop, spinning drop, drop volume or Wilhelmy plate method. For the purposes of the present invention, interfacial tension is measured by the Wilhelmy plate method, using a Kruss Processor Tensiometer K12, at 25° C.

For some systems, the interfacial tension may change whilst undergoing shearing forces typically encountered in a wash process. It is customary to refer to the interfacial tension under these conditions as a "dynamic interfacial tension" (DIFT) and may be measured by a maximum bubble pressure technique.

Preferably the amount of the most polar liquid in the composition is from 10 to 90% by volume, preferably from 25 to 90%, more preferably from 40 to 90% and most preferably from 60 to 90%. Preferably the most polar liquid is water and preferably the least polar liquid is petroleum ether, cyclohexane, perchloroethylene or mixtures thereof.

Preferably the agitation time is at least 5 minutes, more preferably at least 15 minutes and most preferably at least 60 minutes.

In a preferred embodiment of the present invention, a fatty acid or fatty amine with a carbon chain length of $C_{12}$ to $C_{22}$ maybe added to the composition.

In another preferred embodiment of the present invention, builders may be added to the composition.

In still another preferred embodiment of the present invention, mineral salts may be added to the composition.

It is possible to incorporate other conventional detergent ingredients such as anti-redeposition agents, soil release polymers, hydrotropes, enzymes, bleaches, fluorescers and perfumes in the composition. However, it is preferred that the composition is free of hydrogen peroxide or water soluble hypochlorites and is more preferably free of bleaching compounds.

In principle, limited amounts of surfactant may be present provided that the interfacial tension is not reduced below 5 mN/m, preferably not below 10 mN/m. However, the composition is preferably free of surfactant.

The invention will now be described in greater detail with reference to immiscible liquid compositions for cleaning fabric.

Liquid Components

More polar liquid components that may be used include water, alcohols, ethers, glycol ethers, ketones, phenols, aldehydes, organic sulphur compounds and nitrogen-containing compounds such as nitrates or nitriles. Less polar liquids which may be used include esters, hydrocarbons, paraffins, aromatic solvents, halogenated solvents, heterocyclic solvents, terpenes, mineral oils and silicone oils. Mixtures of any of these can be used wherein at least one liquid-liquid interface exists and the interfacial tension is at least 5 mN/m, preferably at least 10 mN/m. Preferably only two liquids are used. As previously indicated, water is a preferred polar liquid, and the less polar liquid is preferably a hydrocarbon, more preferably petroleum ether or cyclohexane or mixtures thereof, or a halogenated solvent, more preferably perchloroethylene.

The liquid components can be recovered and reused after the cleaning operation.

Fatty Acids and Amines

As previously indicated, fatty acids and fatty amines may be incorporated in the liquid composition as optional ingredients, and may be selected from any one or more with carbon chain length ranging from $C_{12}$ to $C_{22}$, and preferably with a chain length of $C_{18}$ to $C_{22}$. It has been observed that the energy required for agitation may be reduced when fatty acid or amines are incorporated.

Builders

The builders which may be used in the formulation as optional ingredients are preferably inorganic. Suitable builders include, for example, ethylene diamine tetraacetate (EDTA), diethylene triamine pentaacetate (DTPA), sodium tripolyphosphate (STPP), alkali metal aluminosilicates (zeolites), alkali metal carbonate, tetrasodium pyrophosphate (TSPP), citrates, sodium nitrilotriacetate (NTA), and combinations of these. Builders are suitably used in an amount ranging from 0.01–1% by weight.

Salts

The salts which may be used in the formulation as optional ingredients are preferably mineral salts produced by the neutralisation of a mineral acid. Suitable salts include sodium chloride, potassium chloride, lithium chloride, sodium carbonate. Salts may be present at any suitable level up to and including the point where the liquid components are saturated.

Agitation

Agitation may be provided by any suitable means provided for domestic laundering or industrial laundering. The invention is especially suitable for industrial laundering. It is required that thorough mixing of the separate liquid phases is effected and maintained. For example, impellers that provide a vertical flow profile or a radial flow profile can be used. Agitation may also be provided by a rotation and/or tumbling action.

Other forms of vigorous agitation known in the art, for example gas jets or ultra-sound, can also be employed.

EXAMPLES

The invention is further illustrated by the following non-limiting examples, in which parts and percentages are by weight unless otherwise stated.

Examples 1–3, Comparative Examples A to E

Detergency Evaluation

Reflectance was determined by a Macbeth Colour-eye 7000A reflectometer.

White cotton fabric of reflectance (R460) of 80 was pre-soiled with a mixture of particulate and oily soil such that the fabric reflectance was about 55 at 460 nm wavelength. Test cloths prepared from the fabric were cleaned by three different methods a) dry cleaning b) wet cleaning and c) method of the invention.

Comparative Example A 200 ml of petroleum ether was added to a flask. Test cloths were added to the flask. The cloth:liquor ratio was maintained at 1:20. The flask was shaken vigorously for a period of 10 minutes. The test cloths were removed, dried and the reflectance was measured.

The experiment was repeated by agitating the fabric and solvent for a period of 180 minutes.

Comparative Example B

An experiment according to Comparative Example A was carried out. Petroleum ether was replaced by cyclohexane.

Comparative Example C

An experiment according to Comparative Example A was carried out. Petroleum ether was replaced by water.

Comparative Example D

A solution of a conventional detergent formulation (as given in Table 1) of concentration 2.5 g/l was prepared. 200 ml of the solution was added to a flask and the test cloths were introduced into the solution. The cloth:liquor ratio was maintained at 1:20. The test cloths were washed for a period of 10 minutes by shaking the flask vigorously. The test cloths were then removed, rinsed in water and dried. The reflectance of the fabrics was then measured.

The experiment was repeated by agitating the fabric and the detergent solution for a period of 180 minutes.

Comparative Example E

An experiment according to Comparative Example D was carried out where the solution of a conventional detergent formulation (as given in Table 1) had a concentration of 5.0 g/l. The cloth:liquor ratio was maintained at 1:50.

TABLE 1

| Composition | Concentration (% wt) |
|---|---|
| Na linear alkylbenzene sulphonate | 25 |
| Nonionic surfactant $C_{12}E07$ | 0.5 |
| Nonionic surfactant $C_{12}E03$ | 1.5 |
| Soda ash | 23 |
| Sodium tripolyphosphate | 32 |
| Silica | 5.9 |
| Water | To 100 |

Example 1

200 ml of a mixture of petroleum ether and water in a 1:1 ratio by volume was added to a flask. The interfacial tension was measured on a Kruss Tensiometer at 25° C. The interfacial tension (IFT) of the petroleum ether—water interface was 48.2 mN/m. The dynamic interfacial tension (DIFT) as measured by the maximum bubble pressure method was 49.2 mN/m. Test cloths were then introduced in the flask. The cloth:liquor ratio was maintained at 1:20. The flask was then shaken vigorously and the test cloths were allowed to move continuously across the liquid-liquid interface. The test cloths were removed and dried and their reflectance was then measured.

Example 2

A 1:4 by volume mixture of petroleum ether and water was used in the experiment. The interfacial tension (IFT) of the petroleum ether-water interface was 48.2 mN/m. The dynamic interfacial tension (DIFT) as measured by the maximum bubble pressure method was 49.1 mN/m. The procedure given in Example 1 was followed for this experiment.

Example 3

A 1:1 by volume mixture of perchloroethylene and water was used in the experiment. The interfacial tension (IFT) of the perchloroethylene-water interface was 45.1 mN/m. The dynamic interfacial tension (DIFT) as measured by the maximum bubble pressure method was 46.1 mN/m. The procedure given in Example 1 was followed for this experiment.

The results are presented in Table 2.

TABLE 2

| Washing system | Reflectance after 10 min. | Reflectance after 180 min. |
|---|---|---|
| Comparative Example A | 57 | 57 |
| Comparative Example B | 57 | 57 |
| Comparative Example C | 58 | 63 |
| Example 1 | 68 | 78 |
| Example 2 | 68 | 78 |
| Example 3 | 65 | 76 |
| Comparative Example D | 63 | 64 |
| Comparative Example E | 63 | 67 |

The data presented in Table 2 clearly shows that a significant improvement in detergency can be obtained using the method of the invention. The reflectance can be maintained close to that of the original test cloths.

Comparative Examples F to H and Example 4

Detergency Evaluation of Consumer Garments

Cotton vests with a starting reflectance of 80 were given to a panel of 6 members. The reflectance of the garments after use averaged 55. Test cloths were prepared from the garments after use and washed by a) wet cleaning b) dry cleaning and c) the method of the invention. The reflectance was measured using Macbeth Colour-eye 7000A reflectometer.

Comparative Example F

The soiled test cloths were soaked in the detergent solution (2.5 g/l) of Comparative Example D and then washed for 15 minutes. The test cloths were then rinsed and dried and the reflectance was measured.

Comparative Example G

The soiled test cloths were boiled in the detergent solution (2.5 g/l) of Comparative Example D, at 100° C. for 30 minutes. The test cloths were then removed, rinsed and dried and the reflectance measured.

Comparative Example H

The soiled test cloths were added to petroleum ether maintaining a cloth:liquor ratio of 1:20 and agitated for 30 minutes. The test cloths were then removed, dried and the reflectance measured.

Example 4

The soiled test cloths were added to a mixture of petroleum ether and water, in a 1:1 by volume ratio and agitated manually for 10 minutes, ensuring that the test cloths move across the liquid-liquid interface. The test cloths were then removed, dried and the reflectance measured.

For all examples, the damage caused to the fabric was determined. Results are presented in Table 3.

TABLE 3

| | Reflectance (after 15 cycles) | Damage to fabric |
|---|---|---|
| Comparative Example F | 55 | Low |
| Comparative Example G | 74 | High |
| Comparative Example H | 55 | Low |
| Example 4 | 78 | Low |

The data presented in Table 3 shows that this invention can maintain reflectance of a garment very close to the reflectance of a new garment, with minimal or no damage to it. Also it is clear that the cleaning is faster as compared to the comparative methods.

Examples 5 to 8

Detergency Evaluation with Additives

White cotton fabric of reflectance 80 was pre-soiled with a mixture of particulate and oily soil such that the fabric reflectance was about 55 at 460 nm wavelength. Test cloths were prepared from the fabric. Stearic acid, STPP, sodium chloride and potassium chloride were added to a 1:1 mixture of petroleum ether and water and the effect on cleaning of the test cloths was determined.

Example 5

0.028 g of stearic acid was added to 100 ml of water which was then blended with 100 ml of petroleum ether, providing approximately a 1:1 mixture of petroleum ether and stearic acid solution, and was added to a flask. The interfacial tension (IFT) of the mixture, as recorded on a Kruss Tensiometer at 25° C. was 33.0 mN/m. The dynamic interfacial tension (DIFT) as measured by the maximum bubble pressure method was 39.4 mN/m. Test cloths were then introduced in the flask. The cloth:liquor ratio was maintained at 1:20. The flask was then shaken vigorously and the test cloths were allowed to move continuously across the liquid-liquid interface. The test cloths were removed and dried and their reflectance was then measured.

Example 6

0.5 g of STPP was added to 100 ml of water which was then blended with 100 ml of petroleum ether, providing approximately a 1:1 mixture of petroleum ether and STPP solution, and was added to a flask. The interfacial tension (IFT) of the mixture was 39.6 mN/m. The dynamic interfacial tension (DIFT) as measured by the maximum bubble pressure method was 41.3 mN/m. The procedure as given in Example 5 was followed to determine detergency.

Example 7

20 g of sodium chloride was added to 100 ml of water which was then blended with 100 ml of petroleum ether, providing approximately a 1:1 mixture of petroleum ether and sodium chloride solution, and was added to a flask. The interfacial tension (IFT) of the mixture was 52.3 mN/m. The dynamic interfacial tension (DIFT) as measured by the maximum bubble pressure method was 53.2 mN/m. The procedure as given in Example 5 was followed to determine detergency.

Example 8

15 g of potassium chloride was added to 100 ml of water which was then blended with 100 ml of petroleum ether, providing approximately a 1:1 mixture of petroleum ether and potassium chloride solution, and was added to a flask. The interfacial tension (IFT) of the mixture was 53.1 mN/m. The dynamic interfacial tension (DIFT) as measured by the maximum bubble pressure method was 53.2 mN/m. The procedure as given in Example 5 was followed to determine detergency.

The data resulting from addition of stearic acid, STPP, sodium chloride and potassium chloride to the solvent mixture together with data for the additive-free example 1 are presented in Table 4 and Table 5.

TABLE 4

| | 1 | 5 | 6 | 7 | 8 |
|---|---|---|---|---|---|
| Wash time (mins) | 15 | 15 | 15 | 15 | — |
| Reflectance | 67 | 71 | 70 | 71 | — |

TABLE 5

| | 1 | 5 | 6 | 7 | 8 |
|---|---|---|---|---|---|
| Wash time (mins) | 180 | 140 | 145 | 120 | 120 |
| Reflectance | 78 | 78 | 77 | 78 | 78 |

The addition of fatty acid and builder to the solvent mixture results in a further improvement in detergency. The addition of sodium chloride or potassium chloride increases the value of the IFT and results in a further improvement in detergency. Alternatively the wash time may be reduced for the same given level of detergency using these additives.

Examples 9 and 10

Examples of Product Formulations

Two formulations were made up in order to determine the effect of the many additives typical of a detergent wash formulation on the values of the interfacial tension (IFT) and the dynamic interfacial tension (DIFT).

Example 9

The additives listed below in Table 6 were dissolved into 240 ml of water which was subsequently blended with 60 ml of perchloroethylene. The interfacial tension (IFT) of the mixture was 10.0 mN/m. The dynamic interfacial tension (DIFT) as measured by the maximum bubble pressure method was 33.1 mN/m.

Example 10

The additives listed below in Table 6 were dissolved into 240 ml of water which was subsequently blended with 60 ml of petroleum ether. The interfacial tension (IFT) of the mixture was 10.0 mN/m. The dynamic interfacial tension (DIFT) as measured by the maximum bubble pressure method was 37.6 mN/m.

Reflectance values as measured by the method of example 1, were 70 after 15 minutes and 78 after 180 minutes.

TABLE 6

| Additive | Amount added, g |
|---|---|
| Sodium carbonate | 0.146 |
| STPP | 0.192 |
| Sodium carboxymethyl cellulose | 0.012 |
| Sodium sulphate | 0.003 |
| Precipitated Silica | 0.0276 |
| Tinopal* CBSX (fluorescer) | 0.0006 |
| Laundrosil* PRT2 (photobleach) | 0.012 |
| Perfume | 0.003 |
| Enzymes (Savinase* + Lipolase*) | 0.0036 |
| Sokolan* CP-5 (acrylate/maleate copolymer) | 0.006 |
| Orange-coloured sodium carbonate speckles | 0.006 |
| Moisture | 0.0242 |

*Trade Mark

Table 7 summarises data from some examples above together with further examples and lists the values of both the interfacial tension (IFT) and the dynamic interfacial tension (DIFT).

TABLE 7

| Example | Solvent | Solvent/ Water ratio | Additive | IFT | DIFT |
|---|---|---|---|---|---|
| 1 | Pet. Ether | 1:1 | — | 48.2 | 49.2 |
| 2 | Pet. Ether | 1:4 | — | 48.2 | 49.1 |
| 3 | Perchloro-ethylene | 1:1 | — | 45.1 | 46.1 |
| 5 | Pet. Ether | 1:1 | Stearic Acid | 33.0 | 39.4 |
| 6 | Pet. Ether | 1:1 | STP | 39.6 | 41.3 |
| 7 | Pet. Ether | 1:1 | Sodium chloride | 52.3 | 53.2 |
| 8 | Pet. Ether | 1:1 | Potassium chloride | 53.1 | 53.2 |
| 9 | Perchloro-ethylene | 1:4 | See previously | 10.0 | 33.1 |
| 10 | Pet. Ether | 1:4 | See previously | 10.0 | 37.6 |
| 11 | Pet. Ether | 1:4 | Stearic acid | 33.4 | 40.1 |
| 12 | Pet. Ether | 1:4 | STP | 38.3 | 43.2 |

I claim:

1. A process of cleaning fabric comprising agitating the fabric in a composition comprising at least two liquids, having at least one liquid-liquid interlace with an interfacial tension of at least 5 mN/m, wherein the concentration of the mast polar liquid in the composition is from 25 to 90% by volume, and wherein the less polar liquid is selected from the group consisting of petroleum ether, cyclohexane and mixtures thereof; and the most polar liquid is water.

2. A process according to claim 1, wherein at least one liquid-liquid interface has an interfacial tension of at least 8 mN/m.

3. A process according to claim 1, wherein at least one liquid-liquid interface has an interfacial tension of at least 10 mN/m.

4. A process according to claim 1, wherein at least one liquid-liquid interface has an iriterfacial tension of at least 15 mN/m.

5. A process according to claim 1, wherein at least one liquid-liquid interface has an interfacial tension of at least 20 mN/m.

6. A process according to claim 1, wherein at least one liquid-liquid interface has an interfacial tension of at least 35 mN/m.

7. A process according to claim 1, wherein the concentration of the most polar liquid is from 40 to 90% by volume.

8. A process according to claim 7, wherein the concentration of the most polar liquid is from 60 to 90% by volume.

9. A process according to claim 1, wherein the time of agitation is at least 5 minutes.

10. A process according to claim 9, wherein the time of agitation is at least 15 minutes.

11. A process according to claim, 10, wherein the time of agitation is at least 60 minutes.

12. A process according to claim 1, carried out in the presence of a compound selected from fatty acids and fatty amines having a carbon chain length of $C_{12}$ to $C_{22}$.

13. A process according to claim 1, carried out in the presence of a builder.

14. A process according to claim 1, carried out in the presence of a mineral salt.

15. A process according to claim 1, carried out in the absence of hydrogen peroxide.

16. A process according to claim 1, carried out in the absence of a water soluble hypochlorite.

17. A process according to claim 1, carried out in the absence of any bleaching compounds.

18. A process of cleaning fabric comprising agitating the fabric in a composition comprising at least two liquids, having at least one liquid-liquid interface with an interfacial tension of at least 5 mN/m, wherein the concentration of the most polar liquid in the composition is from 25 to 50% by volume, and wherein the less polar liquid is selected from the group consisting of paraffins, silicone oils, and mixtures thereof; and the most polar liquid is water, wherein the most polar liquid and the less polar liquid are present in a 1:1 ratio by volume value.

* * * * *